US007473068B2

(12) United States Patent
Berentsen

(10) Patent No.: US 7,473,068 B2
(45) Date of Patent: Jan. 6, 2009

(54) HOPPER FOR USE WITH A TRACK HOE

(76) Inventor: Jim D. Berentsen, 6611 195th Ave. SE., Snohomish, WA (US) 98290-7369

( * ) Notice: Subject to any disclaimer, the term of this patent is extended or adjusted under 35 U.S.C. 154(b) by 250 days.

(21) Appl. No.: 11/405,309

(22) Filed: Apr. 17, 2006

(65) Prior Publication Data

US 2007/0243047 A1 Oct. 18, 2007

(51) Int. Cl.
*B65G 65/00* (2006.01)

(52) U.S. Cl. ..... 414/800; 294/68.26

(58) Field of Classification Search ..... 414/724, 414/729; 294/68.26, 68.21; 220/1 T; 212/168, 212/342; 37/403, 398
See application file for complete search history.

(56) References Cited

U.S. PATENT DOCUMENTS 18,540 A * 11/1857 Focht ..... 294/68.26
1,568,488 A * 1/1926 Weeks ..... 294/68.26
6,120,237 A * 9/2000 Cummings et al. ..... 414/729

* cited by examiner

*Primary Examiner*—Donald Underwood
(74) *Attorney, Agent, or Firm*—Black Lowe & Graham PLLC

(57) ABSTRACT

A hopper includes a tray having a floor, first and second lateral walls, and a rear wall. A lift handle pivotally secures to the lateral walls. A dump handle secures to the rear wall. The lift handle includes a cross bar extending transversely across the tray for gripping by the shovel and thumb of a track hoe. Stops engage the lift handle and the tray to maintain the cross bar a minimum distance above the tray to facilitate gripping by the track hoe.

3 Claims, 10 Drawing Sheets

HOPPER FOR USE WITH A TRACK HOE

FIELD OF THE INVENTION

This invention relates generally to track hoes and like machinery, and, in particular, to systems and methods for transporting bulk amounts of material using such machinery.

BACKGROUND OF THE INVENTION

Track hoes and like machinery are often used for digging through hard soil, pavement, and the like. As a result, shovels are sized such that the hydraulics powering the shovel can apply sufficient force to drive a relatively small shovel through the soil or pavement. The articulated arm and hydraulics of the arm are therefore capable of carrying much more material than can be lifted with the shovel. In use, great inefficiencies arise as a shovel sized for penetrating soil is used to transport soil, broken pavement, and other materials into a container such as a dump truck or dumpster. The steps of scooping, lifting, and dumping the undersized shovel must be repeated an excessive number of times in order to load materials broken up by the shovel.

It would therefore be an advancement in the art to provide a system and method for loading, lifting, and dumping large amounts of loose material using a track hoe that took greater advantage of the power and capability of the articulated arm and associated hydraulics of the track hoe.

SUMMARY OF THE INVENTION

A hopper enabling a track hoe to scoop, transport, and unload large volumes of materials is disclosed. The hopper includes a tray defining a full-tray center of gravity. A lift handle and a dump handle are secured to the tray. The lift handle is connected to the tray closer to the full-tray center of gravity than the dump handle, with the full-tray center of gravity between the point of securement of the lift handle and the dump handle. The lift handle pivotally mounts to the tray and includes a cross bar extending transversely across the tray for gripping by the shovel and thumb of a track hoe. Stops engaged the lift handle and the tray to maintain the cross bar a minimum distance above the tray to facilitate gripping by the track hoe.

In one embodiment, the tray includes a floor, first and second lateral walls and a rear wall. The lift handle pivotally secured to the first and second lateral walls by means of U-shaped members pinned to the lateral walls. Portions of the U-shaped members interfering with the first and second lateral walls serve as the stops.

The hopper is filled by various methods, including pushing the hopper into a mound of material or scraping material onto the tray. The hopper is dumped by various methods including lifting upwardly on the dump handle, resting the tray on a wall or a portion of the track hoe such that it tips, or driving a front edge of the tray into a mound of material or other structure to cause tipping.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

Figure 1:
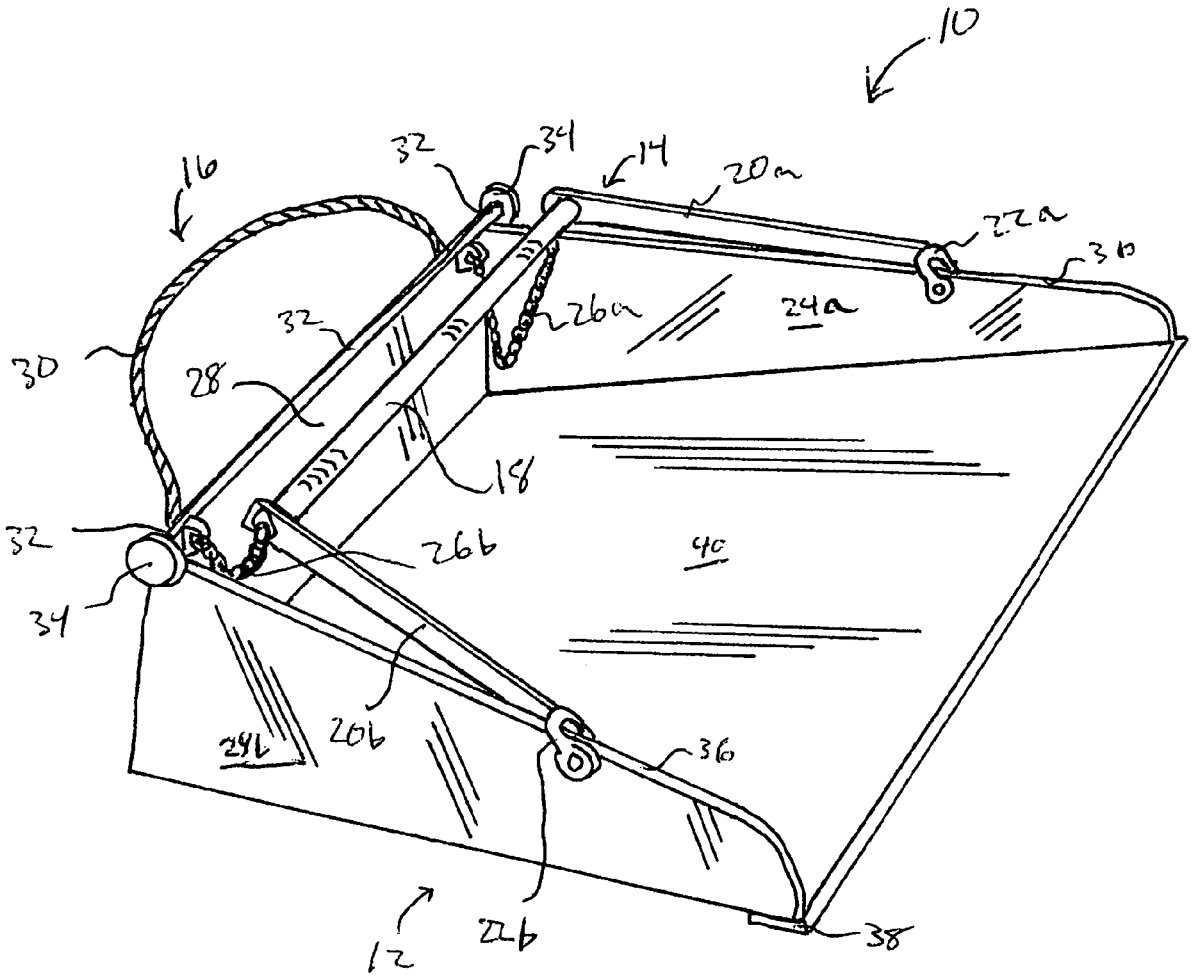
FIG. 1 is a perspective view of a hopper, in accordance with an embodiment of the present invention.
Figure 2:
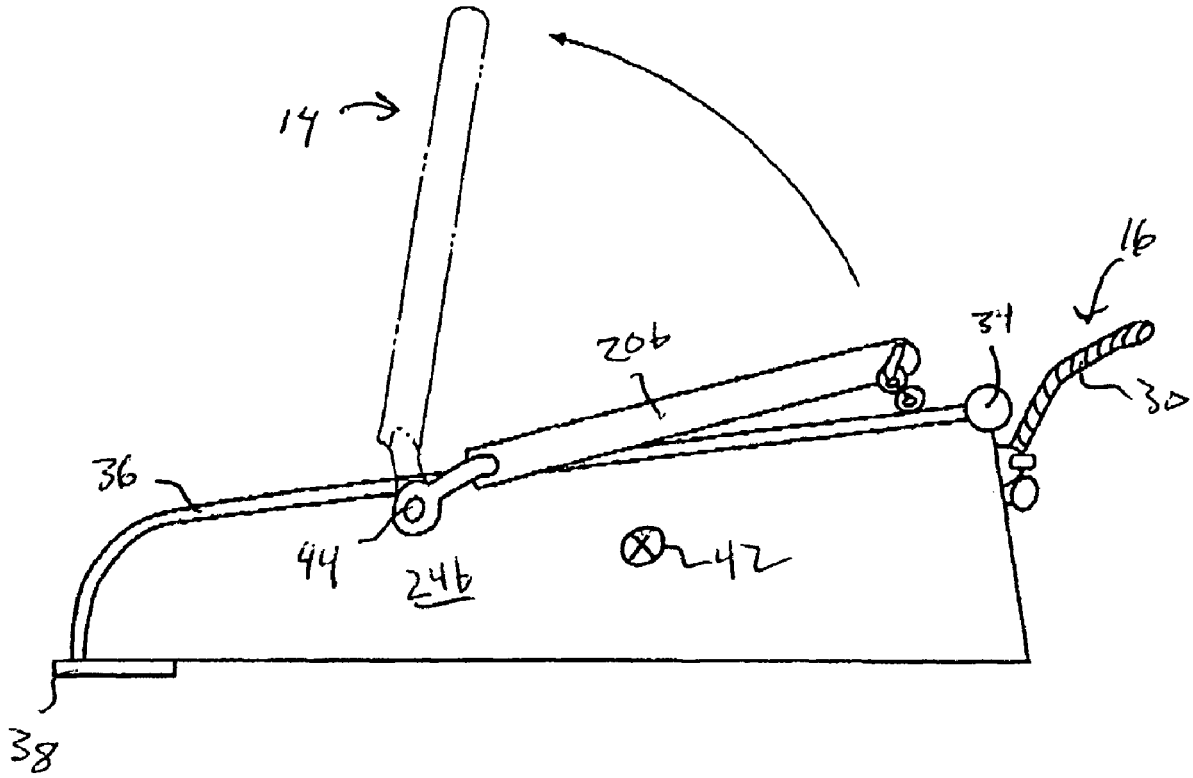
FIG. 2 is a side view of a hopper, in accordance with an embodiment of the present invention.
Figure 3A:
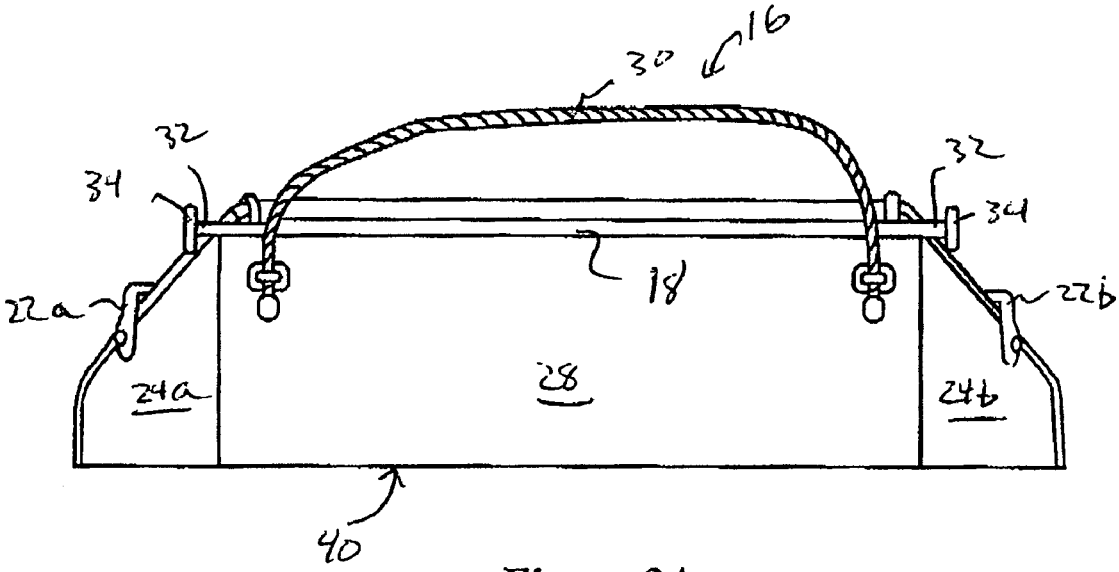
FIG. 3A is a rear view of a hopper, in accordance with an embodiment of the present invention.
Figure 3B:
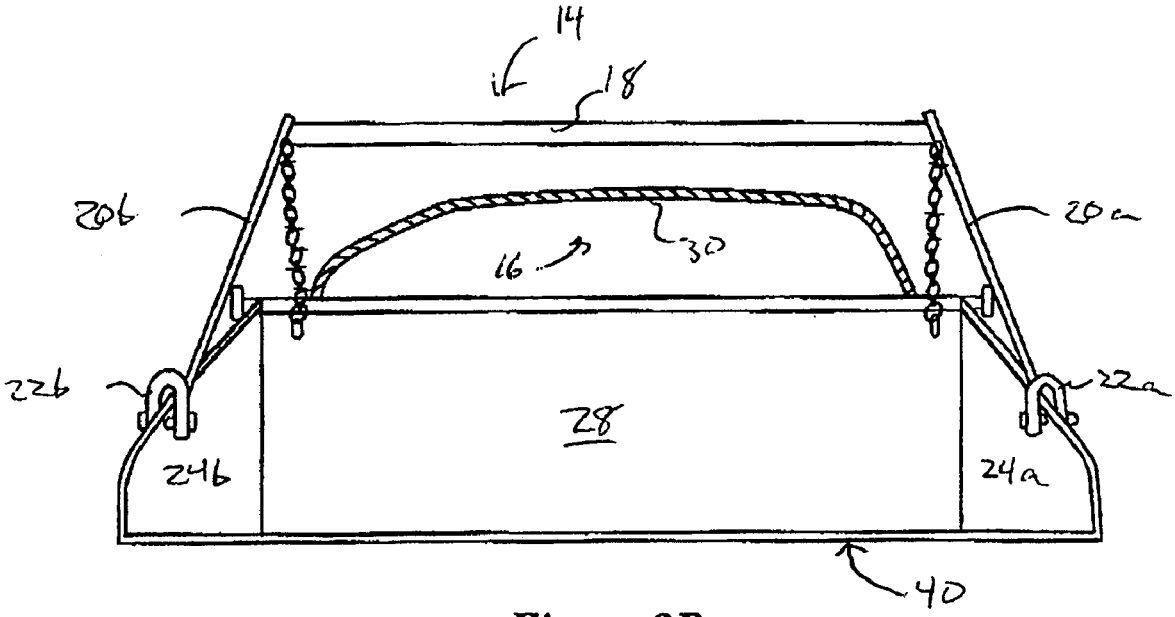
FIG. 3B is a front view of a hopper, in accordance with an embodiment of the present invention.
Figure 4A:
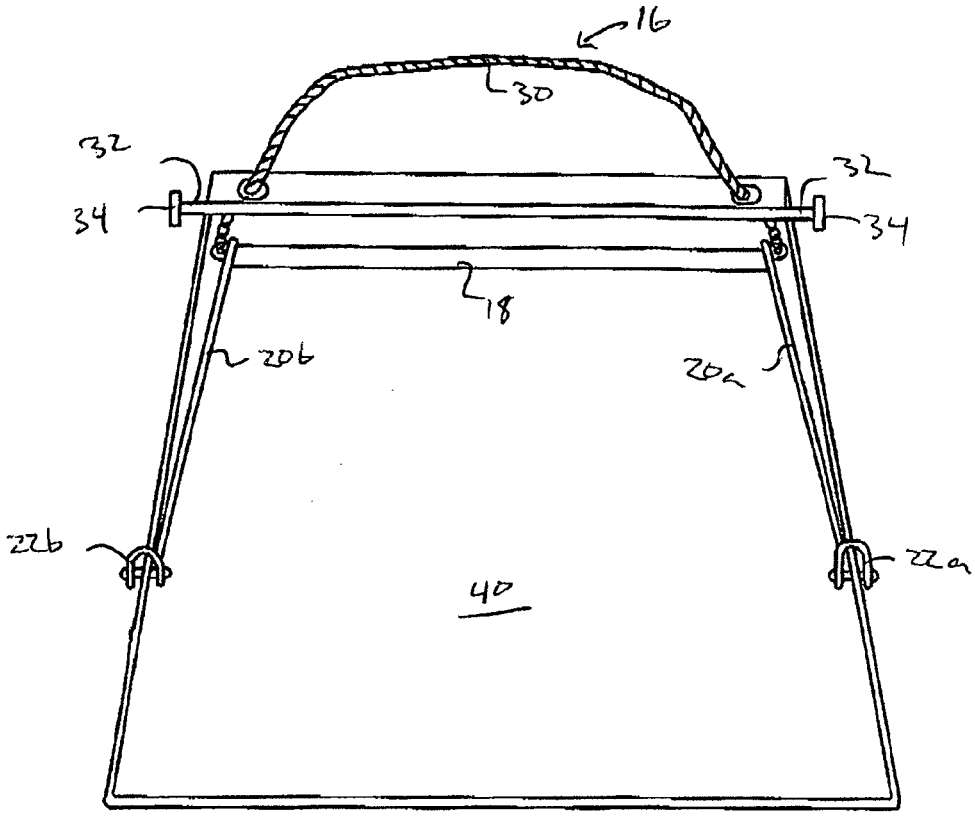
FIG. 4A is a top view of a hopper, in accordance with an embodiment of the present invention.
Figure 4B:
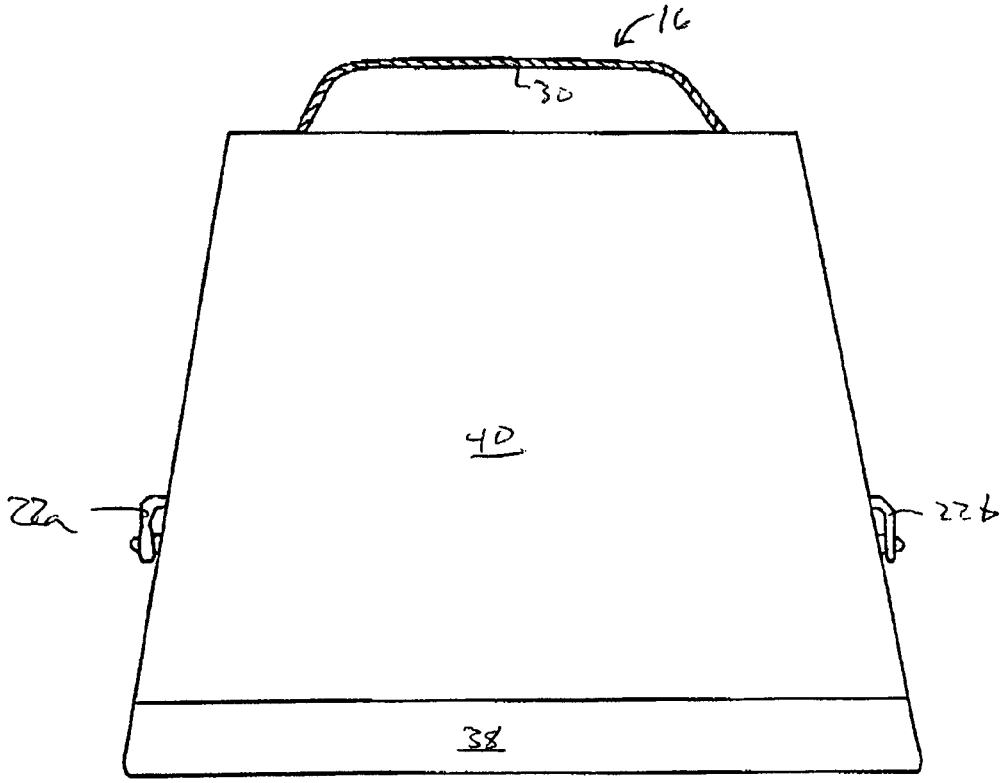
FIG. 4B is a bottom view of a hopper, in accordance with an embodiment of the present invention.

Referring to FIGS. 1 through 4B, a hopper 10 includes a tray 12, a lift handle 14, and a dump handle 16. The lift handle 14 is gripped by the shovel and thumb of a track hoe in order to lift a filled hopper 10. The dump handle 16 is also gripped by the shove and thumb of a track hoe in order to dump the hopper 10.

The lift handle 14 is typically pivotally mounted to the tray 12. In the illustrated embodiment, the lift handle 14 includes a cross bar 18 and two side bars 20*a*, 20*b*. The side bars 20*a*, 20*b* mount to the tray 12 by means of U-shaped members 22*a*, 22*b*. The legs of the U-shaped members 22*a*, 22*b* are pinned to side walls 24*a*, 24*b* forming part of the tray 12. In use, the U-shaped members 22*a*, 22*b* function as stops, interfering with the pivoting of the lift handle 14 such that the cross bar 18 is distanced from the tray 12 such that a portion of the shovel or thumb of a track hoe can be inserted between the cross bar and tray 12 in order to grip the cross bar 18. One or more tethers 26*a*, 26*b* attach to either the cross bar 18 or side bars 20*a*, 20*b* to limit the rotation of the lift handle 14 away from the tray 12. The tethers 26*a*, 26*b* may secure to a portion of the tray such as the lateral walls 24*a*, 24*b* or a rear wall 28. The tethers 26*a*, 26*b* may be embodied as chains extending from the rear wall 28.

The dump handle 16 typically secures to the rear wall 28 of the tray 12. In the illustrated embodiment the dump handle 16 is embodied as a flexible cable 30 secured at its ends to the rear wall 28. Laterally extending knobs 32 may be formed on the tray 12 to facilitate manipulation of the tray 12 as it lays on the ground or other support surface. The knobs 32 may be part of a single bar extending along the entire rear wall 28. The shovel of a track hoe is used to push or pull on the knobs 32 to rotate the tray 12. Cap plates 34 may be formed on the knobs 32. The cap plates 34 may be caught by the shovel of a track hoe to drag the tray 12 laterally.

The tray 12 may have reinforcing members 36 positioned along the upper edges of the lateral walls 24*a*, 24*b* to stiffen the tray and prevent damage from impact with the track hoe or the contents of the hopper 10. A plate 38 may also secure along the exposed edge of a floor 40 extending between the side walls 24*a*, 24*b* and the rear wall 28 to facilitated scraping up material and to resist deformation of the leading edge of the floor 40.

The lateral walls 24*a*, 24*b* taper from a maximum height near the rear wall 28 to a minimum height near the front edge of the floor 40. The floor 40 is typically narrowest near the rear wall 28 and grows wider toward the front edge.

A filled tray 12 has a filled center of gravity 42. In one embodiment the lift handle 14 is pivotable such that the cross bar 18 is substantially directly above the filled center of gravity 42. The lift handle 14 typically secures to the tray 12 at a point of securement 44 such that the filled center of gravity 42 is positioned between the point of securement 44 and the point of securement of the tethers 26*a*, 26*b* to the tray 12, such as the rear wall 28.

Figure 5:
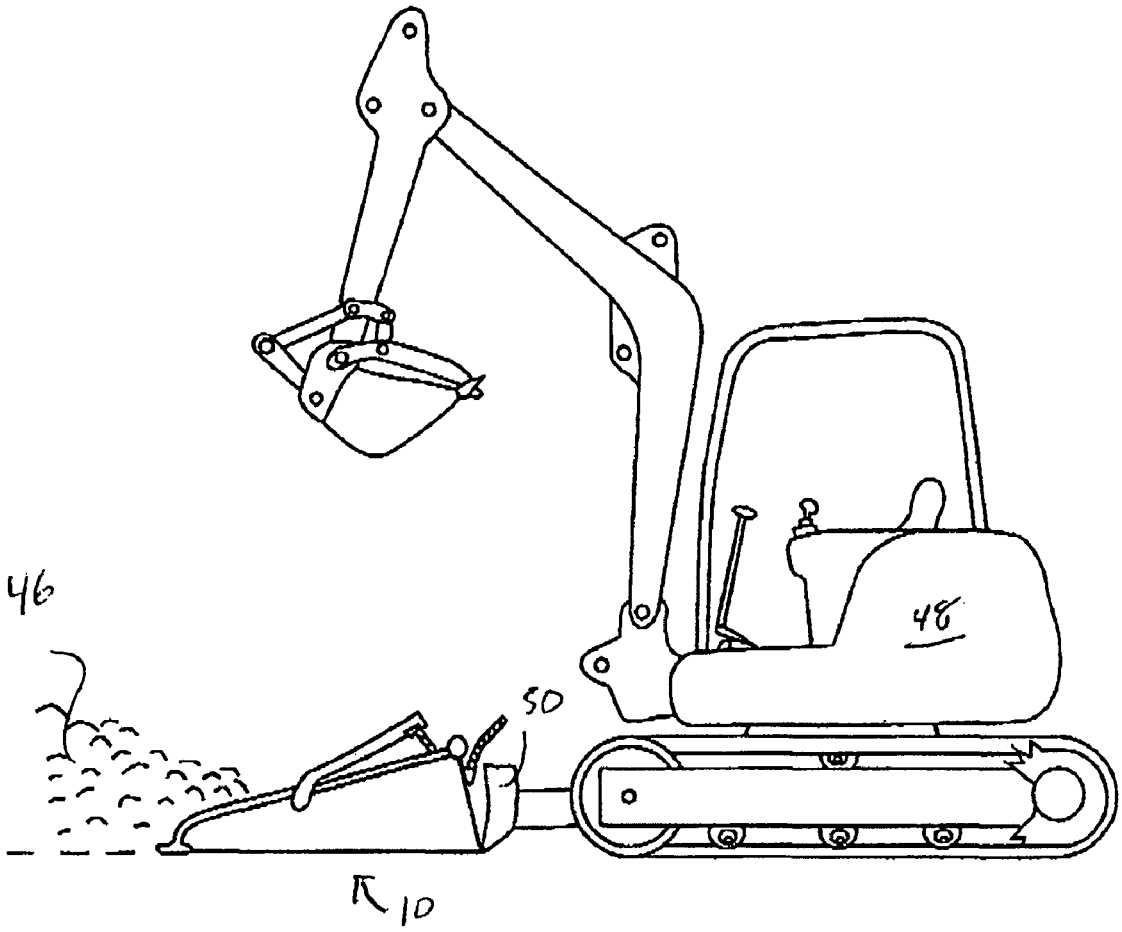
FIG. 5 is a side view of a track hoe and hopper illustrating a method of loading the hopper, in accordance with an embodiment of the present invention.
Figure 6:
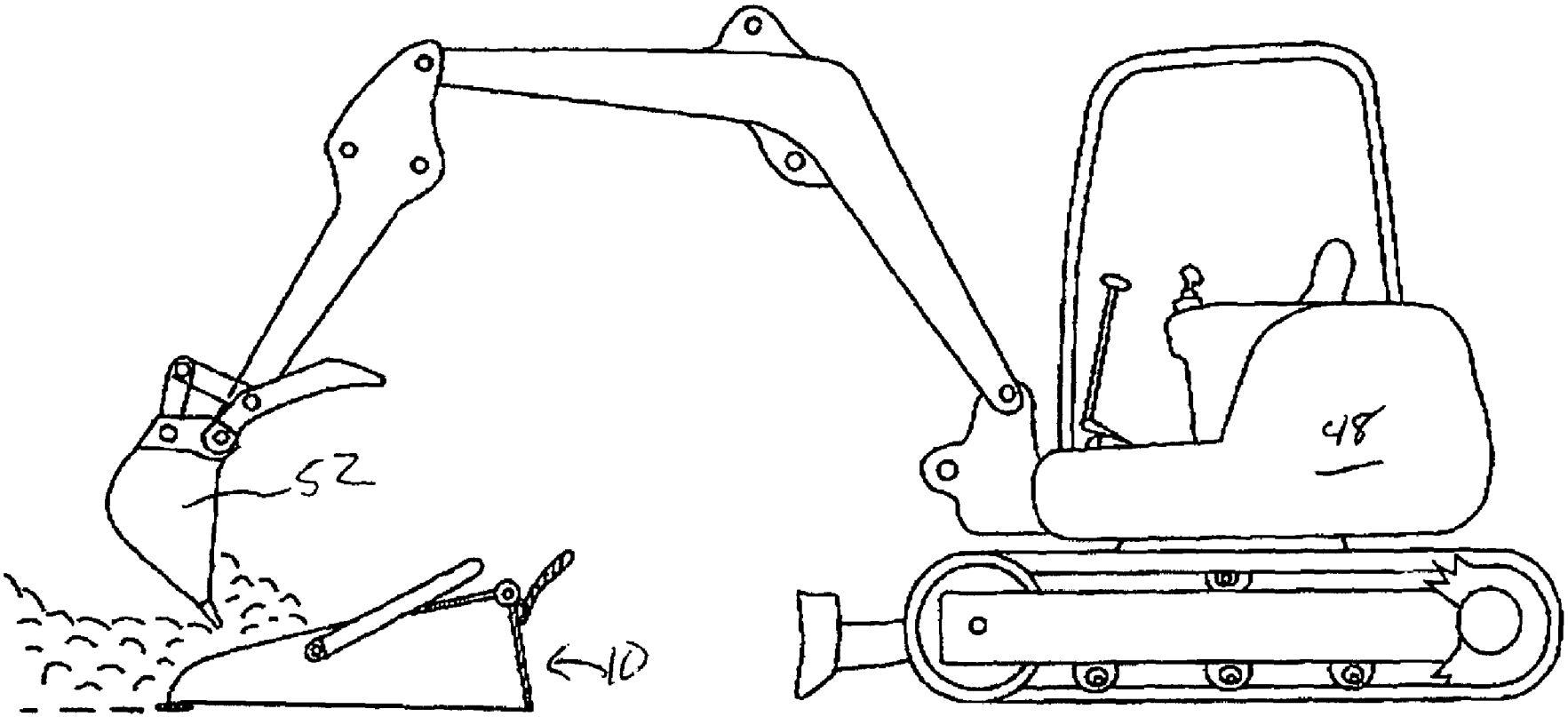
FIG. 6 is a side view of a track hoe and hopper illustrating an alternate method of loading the hopper, in accordance with an embodiment of the present invention.

Referring to FIG. 5, in one method of loading the hopper 10, the hopper 10 is placed in front of a mound 46 of material. A track hoe 48 then pushes the hopper 10 into the mound 46. Many track hoes are provided with a long blade 50 extending along the front of the track hoe near the ground. The blade 50 may therefore be used to drive the hopper 10 into the mound 46. Referring to FIG. 6, in an alternative method of use, the hopper 10 is placed near the mound 46 and the articulated shovel 52 is used to scrape material into the hopper 10. The hopper 10 may be held in place by the blade 50 when using such a method.

The methods of FIG. 5 and 6 made possible by the hopper 10 decreases the amount of movement required by the articulated shovel 52 to scoop up material. Both hopper 10 and material may be located at ground level near one another. Only a single step of lifting and dumping is required to dump the filled hopper, rather than the repeated scooping, lifting, and dumping steps required to load an equivalent volume using the articulated shovel 52 alone.

Figure 7:
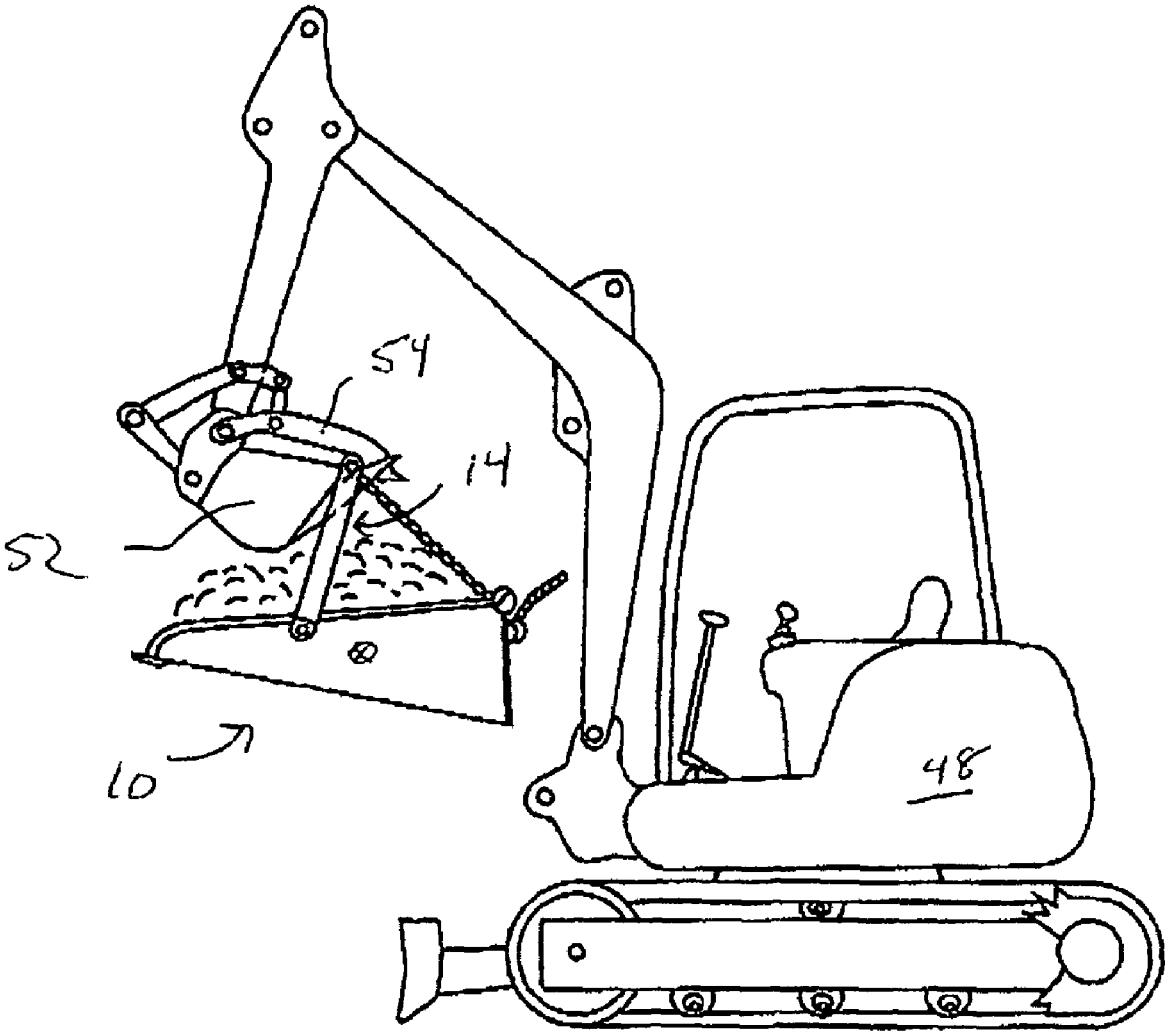
FIG. 7 is a side view of a track hoe and hopper illustrating a method of carrying a loaded hopper, in accordance with an embodiment of the present invention.
Figure 8:
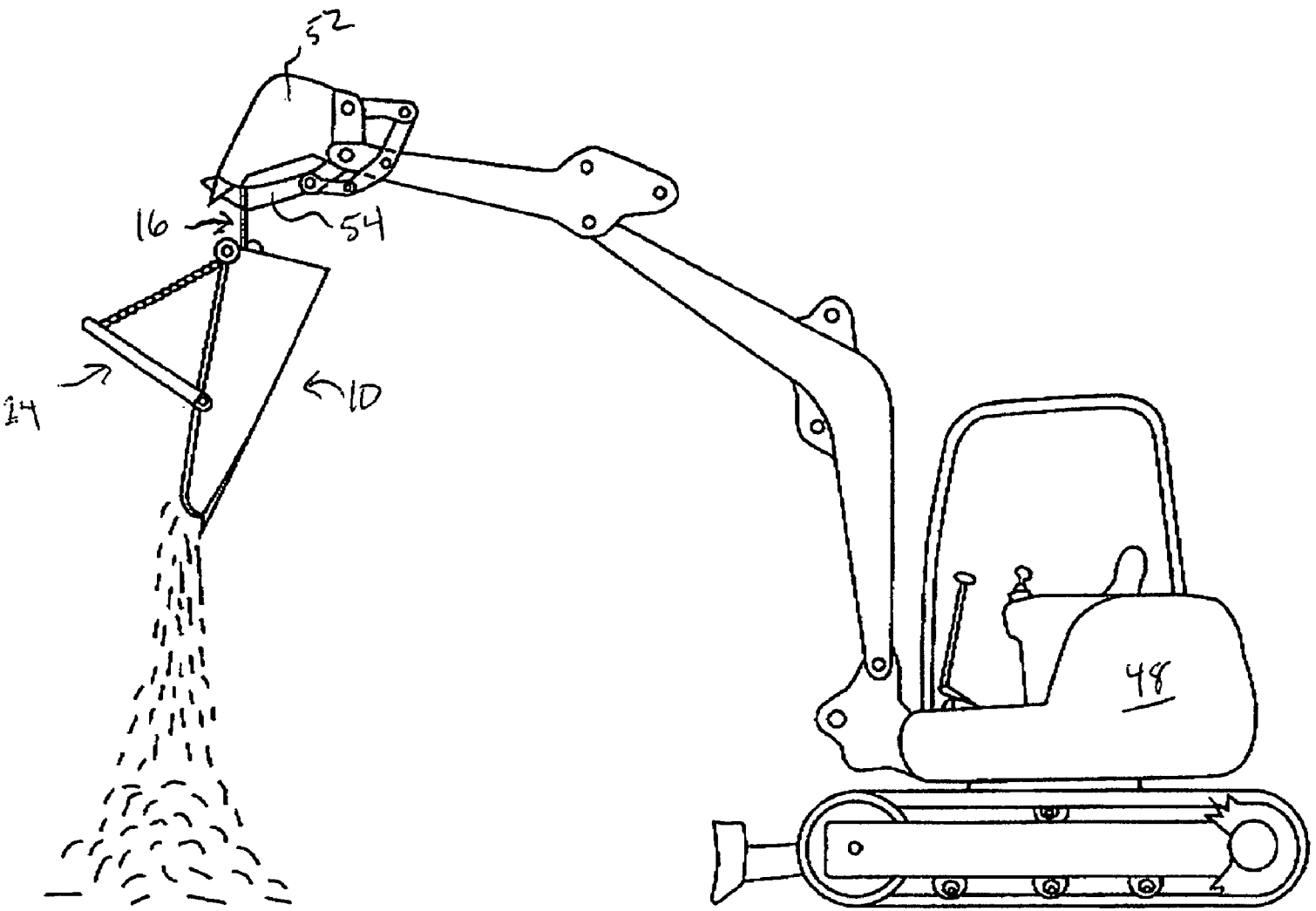
FIG. 8 is a side view of a track hoe and hopper illustrating a method of dumping the hopper, in accordance with an embodiment of the present invention.
Figure 9:
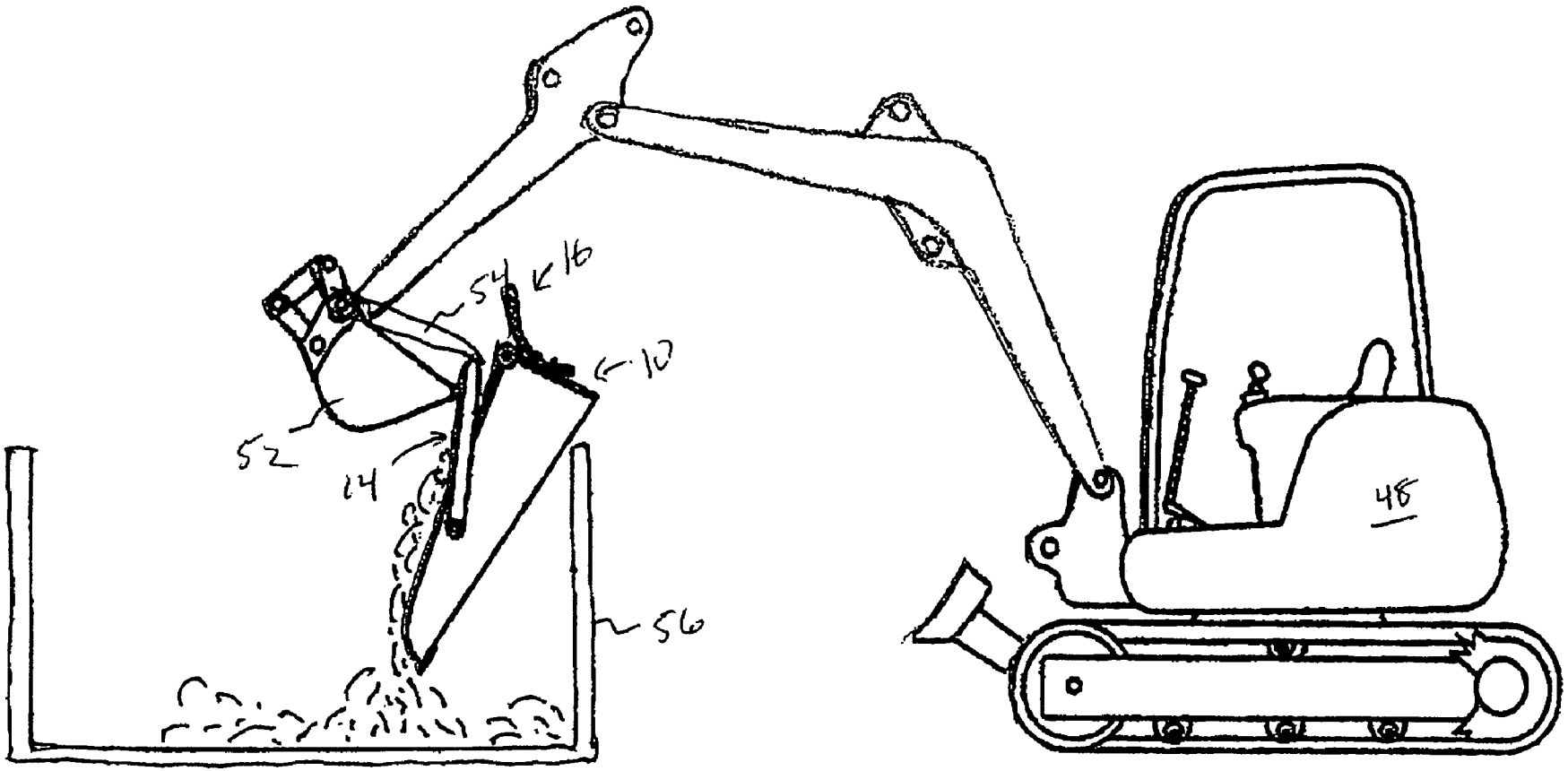
FIG. 9 is a side view of a track hoe and hopper illustrating an alternate method of dumping the hopper, in accordance with an embodiment of the present invention.
Figure 10:
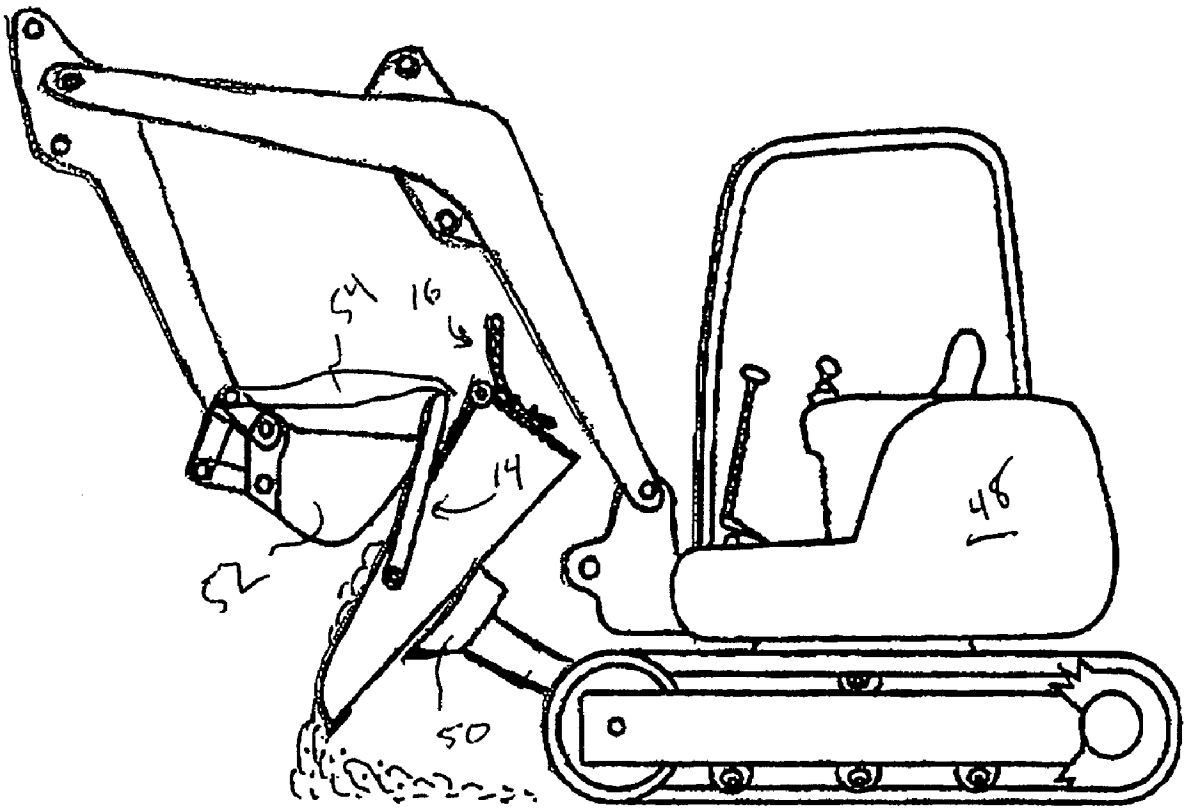
FIG. 10 is a side view of a track hoe and hopper illustrating another alternate method of dumping the hopper, in accordance with an embodiment of the present invention.

Referring to FIG. 7, to lift the hopper 10, the lift handle 14 is gripped by capturing the cross bar 18 between the shovel 52 and thumb 54 of the track hoe 48. The hopper 10 is then transported to a different location and dumped. In the method of FIG. 8, the shovel 52 and thumb 54 grip the dump handle 16 and lift upwardly to dump the hopper 10. In the method of FIG. 8, the underside of the tray 12 proximate the rear wall 28 is lowered onto a structure, such as a side wall 56 of a truck. As the hopper 10 is lowered further it tips and dumps its contents. In a specific embodiment of this method shown in FIG. 9, the tray 12 is rested on the top of the blade 50 to cause the hopper 10 to tip. The track hoe 48 may be driven forward or back during dumping according to this method in order to distribute the contents of the hopper 10. Gravel or other paving material may be distributed as it is driven over by the track hoe 48 in order to pave a road. The blade 50 may be used in this method to simultaneously distribute the contents of the hopper 10 evenly over the road. Other methods may also be used to tip the hopper 10, including driving the front edge of the tray against a mound of already dumped material or other structure to cause tipping.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A hopper for transporting materials comprising:

a tray having a full-tray center of gravity, wherein the tray comprises a floor, first and second lateral walls secured to the floor, and a rear wall secured to the floor and the first and second lateral walls, a lift handle secured to the first and second lateral walls, the lift handle comprises first and second U-shaped members secured to the first and second lateral walls, a stop comprises portions of the U-shaped members selectively positionable in contact with the first and second lateral walls;

the lift handle pivotally mounted to the tray, wherein the lift handle comprises a cross bar extending transversely across the tray, the a stop engaging the tray to maintain the cross bar a minimum distance from the tray; and a dump handle secured to the tray, the full-tray center of gravity being between the lift handle and the dump handle, the lift handle secured to the tray at a point closer to the full-tray center of gravity than the dump handle.

2. The hopper of claim 1, wherein the dump handle comprises a substantially flexible strap secured to the rear wall.

3. A method for handling materials comprising:

providing a tray having a lift handle and a dump handle secured to the tray;

providing a track hoe having an articulated arm having a shovel secured near a distal end thereof and a thumb secured to the articulated arm and selectively positioned across the shovel;

depositing material on the tray;

gripping the lift handle between the shovel and thumb;

lifting the tray; and tipping the tray to drop the material, wherein tipping the tray comprises resting a peripheral portion of the tray on a portion of the track hoe.

* * * * *